US006903642B2

(12) United States Patent
Mayfield et al.

(10) Patent No.: US 6,903,642 B2
(45) Date of Patent: Jun. 7, 2005

(54) TRANSFORMERS

(75) Inventors: Glenn A. Mayfield, West Lafayette, IN (US); Shannon Edwards, Lafayette, IN (US)

(73) Assignee: Radian Research, Inc., Lafayette, IN (US)

( * ) Notice: Subject to any disclaimer, the term of this patent is extended or adjusted under 35 U.S.C. 154(b) by 0 days.

(21) Appl. No.: 10/308,753

(22) Filed: Dec. 3, 2002

(65) Prior Publication Data

US 2003/0137382 A1 Jul. 24, 2003

Related U.S. Application Data

(60) Provisional application No. 60/338,784, filed on Dec. 3, 2001.

(51) Int. Cl.[7] ..... H01F 27/02

(52) U.S. Cl. ..... 336/90; 336/176; 336/96

(58) Field of Search ..... 336/176, 90, 92, 336/96; 323/355

(56) References Cited

U.S. PATENT DOCUMENTS

| | | | | | |
|---|---|---|---|---|---|
| 3,153,758 | A | | 10/1964 | Kusters et al. | |
| 3,188,562 | A | * | 6/1965 | Kusters et al. | 324/726 |
| 3,500,171 | A | | 3/1970 | Kusters et al. | |
| 3,534,247 | A | | 10/1970 | Miljanic | |
| 4,520,335 | A | * | 5/1985 | Rauch et al. | 336/212 |
| 4,841,236 | A | | 6/1989 | Miljanic et al. | |
| 4,888,545 | A | | 12/1989 | Celenza et al. | |
| 5,216,364 | A | | 6/1993 | Ko et al. | |
| 5,235,217 | A | | 8/1993 | Kirton | |
| 5,247,054 | A | * | 9/1993 | Tanaka et al. | 528/220 |
| 5,276,394 | A | | 1/1994 | Mayfield | |
| 5,307,008 | A | | 4/1994 | So | |
| 5,604,669 | A | | 2/1997 | Strong, III | |
| 5,629,092 | A | * | 5/1997 | Gay et al. | 428/407 |
| 5,637,402 | A | * | 6/1997 | Gay | 428/403 |
| 5,652,479 | A | | 7/1997 | Locascio et al. | |
| 5,726,616 | A | * | 3/1998 | Bell | 336/92 |
| 5,754,012 | A | | 5/1998 | Locascio et al. | |
| 5,875,103 | A | | 2/1999 | Bhagwat et al. | |
| 6,157,179 | A | | 12/2000 | Miermans | |
| 6,191,675 | B1 | * | 2/2001 | Sudo et al. | 336/96 |
| 6,271,664 | B1 | * | 8/2001 | Logue | 324/240 |

* cited by examiner

*Primary Examiner*—Anh Mai
(74) *Attorney, Agent, or Firm*—Barnes & Thornburg LLP

(57) ABSTRACT

A transformer includes at least two magnetically coupled cores with a common axis. The cores have cross sectional configurations transverse to the common axis which are not rectangular. An exciting voltage is to be applied across a first winding provided on one of the cores. A second winding provided on one of the cores includes first and second terminals across which a voltage is to be induced in response to the exciting voltage. A first device provides a relatively higher impedance between the first and second terminals of the second winding. The first device is coupled between the first and second terminals. Third, fourth and fifth windings have respective first and second terminals. The third and fourth windings are wound on one of the cores with a first polarity. The fifth winding is wound on one of the cores with a second polarity opposite to the first polarity. A second device provides a relatively higher impedance between the terminals of at least one of the third winding; the fourth winding; and, the fifth winding. One terminal of each of the second, third, fourth and fifth windings is adapted for coupling to a relatively lower impedance.

60 Claims, 5 Drawing Sheets

TRANSFORMERS

CROSS-REFERENCE TO RELATED APPLICATIONS

This application claims priority under 35 U.S.C. § 119(e) to U.S. Provisional Application Ser. No. 60/338,784, filed on Dec. 3, 2001, the disclosure of which is hereby incorporated by reference herein.

FIELD OF THE INVENTION

This invention relates to transformers having compensation circuitry coupled to the windings. However, it is believed to have application to other fields as well.

BACKGROUND OF THE INVENTION

A typical transformer has a primary winding (hereinafter sometimes "primary") magnetically coupled to a secondary winding (hereinafter sometimes "secondary"). The magnetic Coupling is usually accomplished with one or more magnetic cores about which the primary and secondary are wound. In a so-called "ideal" transformer (that is, one which neither stores nor dissipates energy, has unity coupling coefficients, and has pure inductances of infinite value), current flowing in the primary induces a current flow in the secondary that is equal to the current in the primary times the ratio of the number of turns of the primary to the number of turns of the secondary. In real, non-ideal transformers, losses arise from factors such as winding resistances, magnetic flux changes, unequal magnetic flux sharing between the primary and secondary, eddy currents, loads coupled in circuit with the secondary, and other factors. The cumulative result of all these factors is that the current flowing in the secondary is not related to the current flowing in the primary by the turns ratio.

Precision measurement devices, such as watt-hour meters, have transformers and associated circuitry that senses current flowing from generating equipment of, for example, an electric utility, through the measurement device to a customer. Increasing the accuracy of such measurement devices results in more accurate billing of customers for their consumption of electricity. Transformers having electrical circuitry that compensates for the non-ideal nature of the current relationship between current flow in the primary and current flow in the secondary are known. See, for example, U.S. Pat. Nos. 3,153,758; 3,500,171; 3,534,247; 4,841,236; 5,276,394; and 5,307,008. This listing does not constitute a representation that a thorough search of all relevant prior art has been conducted, or that there is no more relevant prior art than that listed, or that the prior art listed is material to patentability. Nor should any such representation be inferred.

DISCLOSURE OF THE INVENTION

According to one aspect of the invention, a transformer includes at least one core of ferromagnetic material, a first winding across which an exciting voltage is to be applied, and a second winding. Each of the first and second windings is provided on one of the cores. The second winding includes first and second terminals across which a voltage is to be induced in response to the exciting voltage A first device provides a relatively higher impedance between the first and second terminals of the second winding. The first device is coupled between the first and second terminals. One of the terminals of the second winding is adapted for coupling to a relatively lower impedance. Third, fourth and fifth windings each have respective first and second terminals. The third and fourth windings being wound on one of the cores with a first polarity. The fifth winding is wound on one of the cores with a second polarity opposite to the first polarity. A second device provides a relatively higher impedance between the terminals of at least one of the third winding; the fourth winding; and, the fifth winding. One of the first and second terminals of each of the third, fourth and fifth windings is also adapted for coupling to the relatively lower impedance.

Illustratively according to this aspect of the invention, the first device comprises a first amplifier having an output terminal characterized by a relatively lower impedance and an input terminal characterized by a relatively higher impedance.

Further illustratively according to this aspect of the invention, the said one of the terminals of the second winding is further coupled to the input terminal of the first amplifier.

Additionally illustratively according to this aspect of the invention, the first amplifier comprises a substantially unity-gain amplifier.

Illustratively according to this aspect of the invention, the second device comprises a second amplifier having an output terminal characterized by a relatively lower impedance and an input terminal characterized by a relatively higher impedance.

Further illustratively according to this aspect of the invention, the said one of the terminals of the third winding is further coupled to the input terminal of the second amplifier.

Additionally illustratively according to this aspect of the invention, at DC, the second amplifier comprises a substantially unity-gain amplifier.

Further illustratively according to this aspect of the invention, the second amplifier comprises a differential amplifier having inverting and non-inverting input terminals. A third device is characterized by a relatively low impedance at DC The third device couples the output terminal of the second amplifier to the inverting input terminal of the second amplifier to constitute the second amplifier a unity gain amplifier at DC.

Additionally according to this aspect of the invention, the third device comprises a bifilar inductor having a sixth winding and a seventh winding. The sixth and seventh windings are wound with the same polarity. The sixth and seventh windings include a common terminal coupled to the output terminal of the second amplifier. The remaining terminal of the sixth winding is coupled to the first terminal of the third winding. The remaining terminal of the seventh winding is coupled to the input terminal of the second amplifier.

Illustratively according to this aspect of the invention, the transformer includes at least two cores with parallel axes. At least one of the first, second, third, fourth and fifth windings is wound on one of the cores. At least one of the first, second, third, fourth and fifth windings is wound on the other of the cores.

Further illustratively according to this aspect of the invention, the at least two cores have common axes.

Additionally illustratively according to this aspect of the invention, at least one of the cores is constructed from moldable ferromagnetic material.

Further illustratively according to this aspect of the invention, said at least one core is molded in multiple parts.

The multiple parts are joined together during assembly of the transformer.

According to another aspect of the invention, a transformer comprises at least two magnetically coupled cores with a common axis. At least one winding is wound on one of the cores. The cores have cross sectional configurations transverse to the common axis which are not rectangular.

Illustratively according to this aspect of the invention, at least one of the cores is constructed from moldable ferromagnetic material.

Further illustratively according to this aspect of the invention, at least one winding is wound on each of the cores.

Additionally illustratively according to this aspect of the invention, the combination comprises more than two cores with a common axis. At least one winding is wound on each of at least two of the cores.

Illustratively according to this aspect of the invention, one or more of the cores is or are constructed from moldable ferromagnetic material.

Further illustratively according to this aspect of the invention, a first one of the windings is provided on a first one of the cores. A second one of the windings is provided on a second one of the cores. The second winding includes first and second terminals across which a voltage is to be induced in response to an exciting voltage applied across said first one of the windings. A first device provides a first impedance between the first and second terminals of the second winding. The first device is coupled between the first and second terminals.

Additionally illustratively according to this aspect of the invention, the first device for providing a first impedance between the first and second terminals of the second winding comprises a first device for providing a relatively higher impedance between the first and second terminals of the second winding. One of the terminals of the second winding is adapted for coupling to a relatively lower impedance.

Illustratively according to this aspect of the invention, the first device comprises a first amplifier having an output terminal characterized by a relatively lower impedance and an input terminal characterized by a relatively higher impedance.

Further illustratively according to this aspect of the invention, the said one of the terminals of the second winding is further coupled to the input terminal of the first amplifier.

Additionally illustratively according to this aspect of the invention, the first amplifier comprises a substantially unity-gain amplifier.

Illustratively according to this aspect of the invention, the combination further comprises third, fourth and fifth windings. Each of the third, fourth and fifth windings has respective first and second terminals. The third and forth windings are each wound on one of the cores with a first polarity. The fifth winding is wound on one of the cores with a second polarity opposite to the first polarity. A second device for provides a relatively higher impedance between at least one pair of the following pairs of terminals: the first and second terminals of the third winding; the first and second terminals of the fourth winding; and, the first and second terminals of the fifth winding. One of the first and second terminals of each of the third, fourth and fifth windings is also adapted for coupling to the relatively lower impedance.

Further illustratively according to this aspect of the invention, the second device comprises a second amplifier having an output terminal characterized by a relatively lower impedance and an input terminal characterized by a relatively higher impedance.

Additionally illustratively according to this aspect of the invention, the said one of the terminals of the third winding is further coupled to the input terminal of the second amplifier.

Illustratively according to this aspect of the invention, at DC, the second amplifier comprises a substantially unity-gain amplifier.

Illustratively according to this aspect of the invention, the second amplifier comprises a differential amplifier having inverting and non-inverting input terminals. The combination further includes a third device characterized by a relatively low impedance at DC for coupling the output terminal of the second amplifier to the inverting input terminal of the second amplifier at DC to constitute the second amplifier a unity gain amplifier at DC.

Further illustratively according to this aspect of the invention, the third device comprises a bifilar inductor having a sixth winding and a seventh winding. The sixth and seventh windings are wound with the same polarity. The sixth and seventh windings include a common terminal coupled to the output terminal of the second amplifier. The remaining terminal of the sixth winding is coupled to the first terminal of the third winding and the remaining terminal of the seventh winding is coupled to the input terminal of the second amplifier.

According to another aspect of the invention, a transformer includes at least one core of ferromagnetic material, and a first winding across which an exciting voltage is to be applied. The first winding is provided on one of the cores. The transformer further includes second, third and fourth windings. Each of the second, third and fourth windings has respective first and second terminals. The second and third windings are wound on one of the cores with a first polarity. The fourth winding is wound on one of the cores with a second polarity opposite to the first polarity. A first device provides a relatively higher impedance between at least one pair of the following pairs of terminals: the first and second terminals of the second winding; the first and second terminals of the third winding; and, the first and second terminals of the fourth winding. One of the first and second terminals of each of the second, third and fourth windings is also adapted for coupling to a relatively lower impedance. The transformer further includes fifth, sixth and seventh windings. Each of the fifth, sixth and seventh winding has respective first and second terminals. The fifth and sixth windings are wound on one of the cores with a first polarity. The seventh winding is wound on one of the cores with a second polarity opposite to the first polarity. A is second device provides a relatively higher impedance between at least one pair of the following pairs of terminals: the first and second terminals of the filth winding; the first and second terminals of the sixth winding; and, the first and second terminals of the seventh winding. One of the first and second terminals of each of the fifth, sixth and seventh windings is also adapted for coupling to the relatively lower impedance.

Illustratively according to this aspect of the invention, the first and second devices comprise a first amplifier and a second amplifier, respectively. Each of the first and second amplifiers has an output terminal characterized by a relatively lower impedance and an input terminal characterized by a relatively higher impedance.

Further illustratively according to this aspect of the invention, the said one of the terminals of the second winding is coupled to the input terminal of the first amplifier. The said one of the terminals of the fifth winding is also coupled to the input terminal of the second amplifier.

Additionally illustratively according to this aspect of the invention, each of the first and second amplifiers comprises a substantially unity-gain amplifier.

Illustratively according to this aspect of the invention, each of the first and second amplifiers comprises a differential amplifier having inverting and non-inverting input terminals. Third and fourth devices, each characterized by a relatively low impedance at DC, respectively couple the output terminal of the first amplifier to the inverting input terminal of the first amplifier at DC to constitute the first amplifier unity gain amplifier at DC, and the output terminal of the second amplifier to the inverting input terminal of the second amplifier at DC to constitute each of the first and second amplifiers a unity gain amplifier at DC.

Further illustratively according to this aspect of the invention, each of the third and fourth devices comprises a bifilar inductor. The third device has an eighth winding and a ninth winding. The eighth and ninth windings are wound with the same polarity. The eighth and ninth windings include a common terminal coupled to the output terminal of the first amplifier. The remaining terminal of the eighth winding is coupled to the first terminal of the second winding and the remaining terminal of the ninth winding is coupled to the input terminal of the first amplifier. The fourth device has a tenth winding and an eleventh winding. The tenth and eleventh windings are wound with the same polarity. The tenth and eleventh windings include a common terminal coupled to the output terminal of the second amplifier. The remaining terminal of the tenth winding is coupled to the first terminal of the fifth winding. The remaining terminal of the eleventh winding is coupled to the input terminal of the second amplifier.

Further illustratively according to this aspect of the invention, the transformer comprises at least two cores with parallel axes. At least one of the first, second, third, fourth, fifth, sixth and seventh windings is wound on one of the cores and at least one of the first, second, third, fourth, fifth, sixth and seventh windings is wound on the other of the cores.

Illustratively according to this aspect of the invention, further comprising more than two cores with parallel axes, at least one of the first, second, third, fourth, fifth, sixth and seventh windings being wound on a first one of the cores, at least one of the first, second, third, fourth, fifth, sixth and seventh windings being wound on a second of the cores, and at least one of the first, second, second, third, fourth, filth, sixth and seventh windings being wound on a third of the cores.

Illustratively according to this aspect of the invention, two or more of the cores have common axes.

Further illustratively according to this aspect of the invention, at least one of the cores is constructed from a moldable ferromagnetic material.

Additionally illustratively according to this aspect of the invention, said at least one core is molded in multiple parts. The multiple parts are joined together during assembly of the transformer.

Further illustratively according to this aspect of the invention, the transformer comprises an eighth winding provided on one of the cores. The eighth winding includes first and second terminals across which a voltage is to be induced in response to the exciting voltage. A third device provides a relatively higher impedance between the first and second terminals of the eighth winding. The third device is coupled between the first and second terminals. One of the terminals of the eighth winding is adapted for coupling to the relatively lower impedance.

Additionally illustratively according to this aspect of the invention, the third device comprises an amplifier having an output terminal characterized by a relatively lower impedance and an input terminal characterized by a relatively higher impedance.

Further illustratively according to this aspect of the invention, the said one of the terminals of the eighth winding is coupled to the input terminal of the third device amplifier.

Illustratively according to this aspect of the invention, the third device amplifier comprises a substantially unity-gain amplifier.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
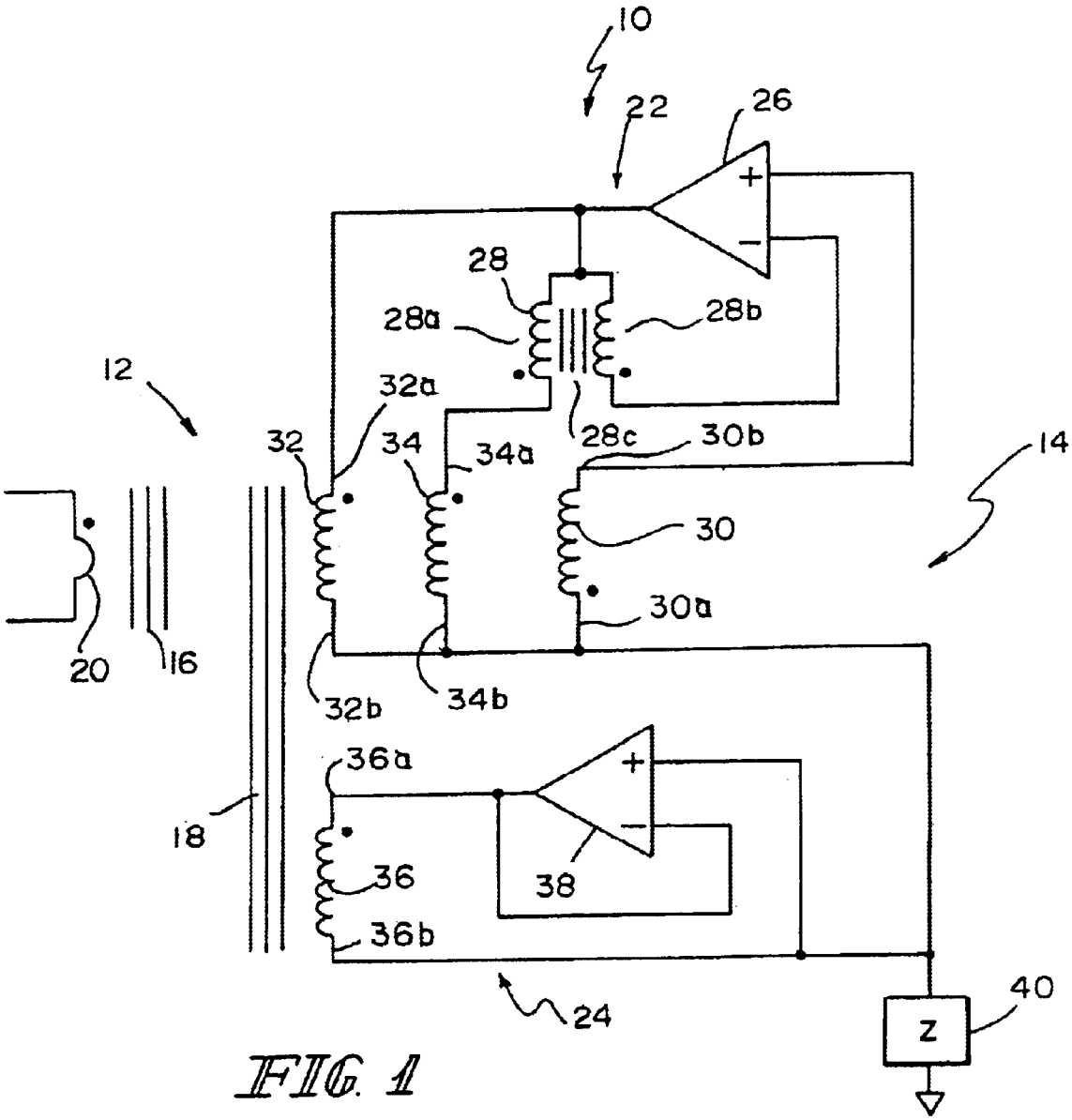
FIG. 1 illustrates a schematic diagram of a transformer and related circuitry helpful in understanding the invention.

Referring now particularly to FIG. 1, an arrangement 10 according to the invention includes a concentric core transformer 12 and associated circuit 14. Transformer 12 includes an outer core 16, an inner core 18, a primary 20, a winding 30, a winding 32, a winding 34, and a winding 36. Winding 30 is wound on core 18 with a polarity opposite to the polarity of primary 20. Windings 32, 34 and 36 are wound on core 18 with the same polarity as primary 20. Terminal 32*a* of winding 32 is coupled to an output terminal of a differential amplifier 26. Terminal 34*a* of winding 34 is coupled through one winding 28*a* of a bifilar inductor 28 to the output terminal of amplifier 26. Terminals 32*b* and 34*b* of windings 32 and 34, respectively, are coupled together and through a load impedance 40 to reference potential (hereinafter sometimes ground). The second winding 28*b* of bifilar inductol 28 is coupled between the output terminal of amplifier 26 and the inverting (–) input terminal of amplifier 26. Windings 28*a* and 28*b* are wound with the same polarity on a core 28*c* of inductor 28. Winding 30 includes a terminal 30*a* coupled to terminals 32*b* and 34*b* of windings 32 and 34. Winding 30 also includes a terminal 30*b* coupled to the non-inverting (+) input terminal of amplifier 26. Winding 36 includes a terminal 36*a* coupled to an output terminal of a differential amplifier 38. The output terminal of amplifier 36 is also coupled to amplifier 36's – input terminal, configuring amplifier 36 as a unity gain amplifier. The other terminal 36*b* of winding 36 is coupled to the + input terminal of amplifier 38 and to terminals 30*a*, 32*b*, 34*b* of windings 30, 32, 34, respectively.

The voltage X current (hereinafter sometimes VA) requirements of load 40 create a so-called VA burden on outer core 16. The VA burden on outer core 16 establishes a magnetic flux in core 16. Flux in the outer core 16 produces a voltage across winding 30. Voltage across winding 30 is applied to the + terminal of amplifier 26. This voltage causes amplifier 26 to generate a correcting voltage across winding 32. The resulting current produces a flux in core 16 which tends to counteract the flux sensed by winding 30, thereby reducing the VA burden of core 16 and the magnetic flux that core 16 therefore must be able to accommodate. The correcting voltage applied to winding 32 induces a current through winding 32. Due to the high input impedances into the input terminals of amplifier 26, a greater portion of the current induced in winding 32 flows in the load 40. The current induced in winding 32 is approximately the current flowing in the primary 20 multiplied by the turns ratio of the primary 20 to the winding 32.

Additionally, all non-ideal transformer windings have non-zero resistances. These winding resistances limit the currents through the windings. Winding 34 is intended to compensate for the current loss owing to the resistance of winding 32. Again, due to the high input impedances into the input terminals of amplifier 26, terminal 34*a* of winding 34 may be thought of as working into an open circuit. Therefore, any voltage appealing across winding 32 which is reflected across winding 34 may be thought of as being applied to the – input terminal of amplifier 26.

Reducing the VA burden of core 16 toward zero reduces the variation of the flux in core 16. When the VA burden of core 16 is held near zero, the limited magnitude of the change in the flux in core 16 improves the ampere-turns accuracy of transformer 10. However, if the VA burden of core 16 is substantially greater than zero, for example, because of DC offset of operational amplifier 26, or because of startup transients in circuit 14, the variation of the flux in core 16 is detrimental to the ampere-turns accuracy of transformer 10. For example, once flux is induced in core 16 by the DC offset of amplifier 26, or from startup transients in circuit 14, an output current may flow in the load 40 without any input current to circuit 14.

Bifilar inductor 28 is intended to address the above-described effects of, for example, DC onset of amplifier 26, startup transients, and the like. At DC, an ideal inductor is a short circuit. Thus, when the frequencies of the exciting currents in windings 28*a* and 28*b* are near DC, the impedances of windings 28*a* and 28*b* are small, assuming the resistances of windings 28*a* and 28*b* are also small. Under these conditions, windings 32 and 34 are effectively coupled in parallel to the output terminal of amplifier 26, and amplifier 26 is effectively coupled in circuit 14 as a unity gain amplifier. Under these conditions, winding 34 provides very little feedback to amplifier 26 and amplifier 26 provides very little compensation for the resistance of winding 32. When amplifier 26 provides little compensation for the resistance in winding 32, the resistance of winding 32 limits the current flow in winding 32. This, in turn, reduces the flux in core 16 and, consequently, the current contributed by winding 32 to the load 40 under the condition of no input to circuit 14.

As the frequency of the currents in windings 28*a*, 28*b* increases, the impedances of windings 28*a*, 28*b* become greater. As this occurs, the circuit behaves more and more as though terminal 34*a* of winding 34 were coupled directly to the + input terminal of amplifier 26. Thus, as the impedances of windings 28*a*, 28*b* become greater and greater, the effective coupling of winding 34 to the – terminal of amplifier 26 to provide feedback thereto increases. As a result, amplifier 26 provides greater and greater compensation for the resistance of winding 32.

Circuit 14 further includes amplifier 38 and winding 36. The output terminal of amplifier 38 is coupled to terminal 36*a* of winding 36 and to the – input terminal of amplifier 38. Amplifier 38 is thus configured as a unity gain voltage follower of the voltage at its + input terminal. The remaining terminal, 36*b*, of winding 36 is coupled to the + input terminal of amplifier 38 and to the load 40.

Magnetic flux corresponding to the difference between the ampere-turns of winding 20 and the ampere-turns of winding 30 produces a voltage across winding 36. This voltage is applied to the + input terminal of amplifier 38. This causes amplifier 38 to apply a current to winding 36 tending to reduce the flux in inner core 18. Once again, owing to the high input impedance into the input terminals of amplifier 38, a greater portion of this correcting current generated in winding 36 is supplied to the load 40. This improves the ampere-turns accuracy of transformer 10. In other embodiments, one or more circuits identical to circuit 22 can be substituted for circuit 24.

Figure 2:
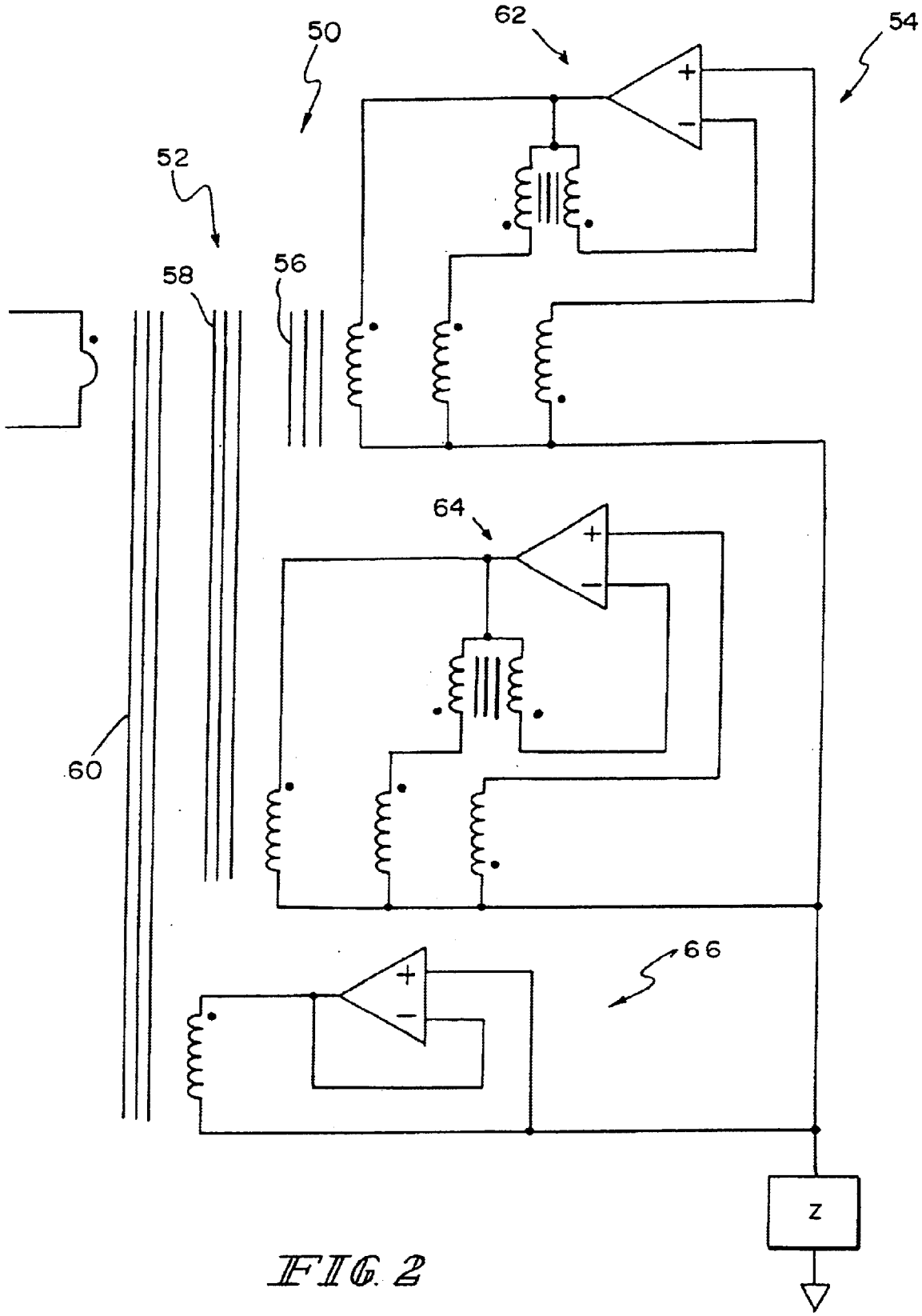
FIG. 2 illustrates another schematic diagram of a transformer and related circuitry helpful in understanding the invention.

Transformers may have more than two cores with parallel or common axes, each provided with flux reducing circuits such as circuit 22 or circuit 24. An example of such a transformer is illustrated schematically in FIG. 2. In FIG. 2, a compensated concentric core transformer 50 includes an outer core 56, a middle core 58, an inner core 60, and a plurality of windings. Circuit 54 Includes a first circuit 62, a second circuit 64, and a third circuit 66.

First circuit 62 is coupled to the outer core 56 of transformer 50 as described above in connection with circuit 22 of FIG. 1. Second circuit 64 having the same configuration as first circuit 62 is coupled to the middle core 58. Circuit 66 having the same configuration as circuit 24 of FIG. 1 is coupled to inner core 60. In other embodiments, circuit 66 may be replaced with a circuit identical to one of circuits 62, 64.

Reducing the flux in an outer core of a concentric core transformer reduces the VA burden of the load that must be supported by the transformer core. Reducing the VA burden that must be supported by the transformer core reduces the amount of magnetic material required in the core. Reducing the amount of magnetic material required permits the design of smaller, lighter and less expensive transformers.

Additionally, the reduction in the VA burden supported by the transformer core makes possible the manufacture of cores from other materials. For example, ferrite materials may be used to construct cores of the general types illustrated and described. Although ferrite materials may have lower permeabilities than, for example, modern supermalloy materials, the permeabilities of ferrites are suitable for the operating conditions experienced by the illustrated and described concentric core transformers.

Producing cores from ferrite materials permits the cores to be molded and/or machined. Molding and/or machining the core materials permits the production of concentric core transformers having as few as three magnetic core parts in as few as two distinct shapes. Additionally, the cross-sectional shapes of the concentric cores can readily be made other than the typical rectangular shapes. Molding or machining the core material permits the production of cores having cross-sectional profiles other than the typical rectangular ones, such as, for example, those illustrated in FIGS. 3*f*, 4, and 6.

The particular concentric core assembly 70 illustrated in FIGS. 3*a–f* has circular or oval cross-sections perpendicular to its perimeter. Assembly 70 includes an outer core 72 and an inner core 92. Illustratively, cores 72 and 92 are both toroidal, core 92 being designed to be housed within core 72. Core 72 includes an interior surface 73 which cooperates with core 92 to define a toroidal winding space 90. Outer core 72 includes a pair of core halves 78 and 80 which are joined along an equator 76 during assembly of a transformer from cores 72, 92. Additionally, outercore 72 may include (an) exit opening(s) 98, or cooperating portions of an exit opening, in one or the other or both of core halves 78 and 80. Leads providing electrical connections to windings on core 92 may be routed through exit opening(s) 98.

Figure 3A:
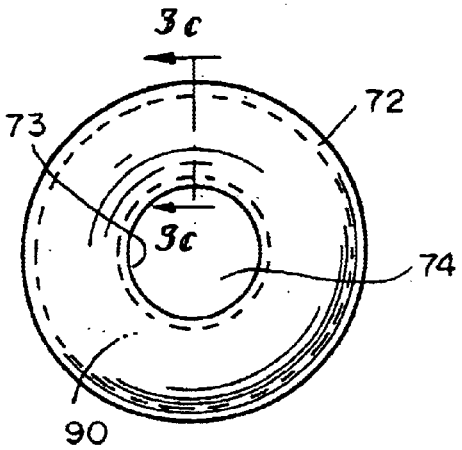
FIG. 3*a* illustrates a view of a core of a transformer.
Figure 3B:
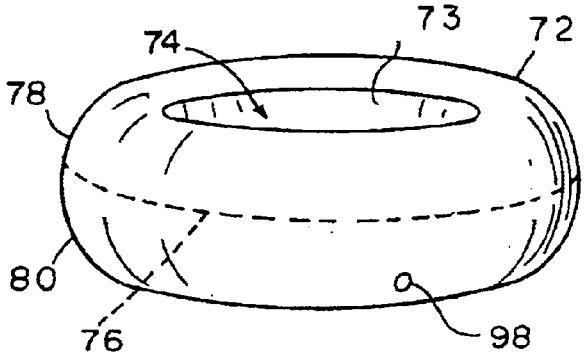
FIG. 3*b* illustrates a perspective view of the core illustrated in FIG. 3*a*, taken generally along section lines 3*b*—3*b* of FIG. 3*a;*
Figure 3C:
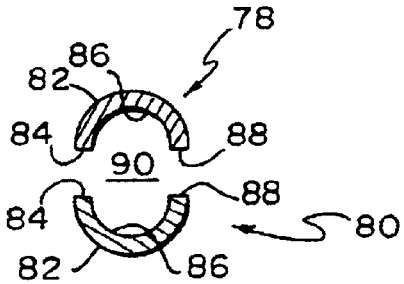
FIG. 3*c* illustrates a fragmentary exploded sectional view of the core illustrated in FIGS. 3*a–b*, taken generally along section lines 3*c*—3*c* of FIG. 3*a;*

Illustratively, core halves 78 and 80 are identically shaped in order that only one component needs to be manufactured. Each core half 78, 80 has a convex outer surface 82 and a concave inner surface 86 which combines with the concave inner surface 86 of the other core half 78, 80 to define the inner surface 73. An annular inner edge 84 and an annular outer edge 88 extend between respective surfaces 82, 86 of each portion 78, 80. In the illustrative embodiment, when the portions 78, 80 of outer core 72 are coupled together, edges 84, 84 and 88, 88 of the core halves 78 and 80 confront or abut each other. In some embodiments, edges 84 and 88 or portions 78, 80 may be separated from each other, for example, by an insulative spacer. When core halves 78 and 80 are coupled together, surfaces 86 of core halves 78 and 80 bound winding space 90, as best illustrated in FIGS. 3*c* and 3*f*.

Figure 3E:
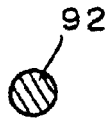
FIG. 3*e* illustrates a fragmentary sectional view of the core illustrated in FIG. 3*d*, taken generally along section lines 3*e*—3*e* of FIG. 3*d;*
Figure 3D:
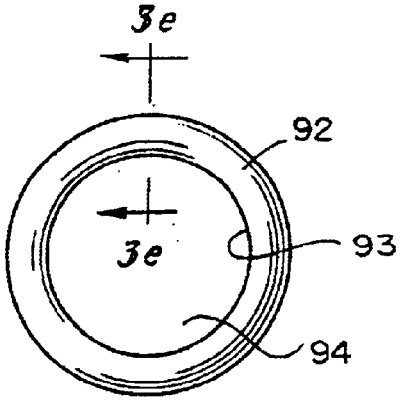
FIG. 3*d* illustrates a view of a core of a transformer.
Figure 3F:
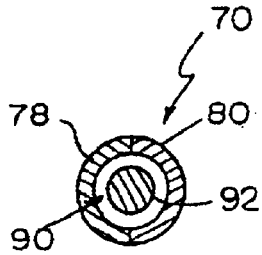
FIG. 3*f* illustrates a fragmentary cross sectional view of the assembled cores illustrated in FIGS. 3*a–c* and 3*d–e;*

Illustratively, core 92 is a one piece core, as best illustrated in FIGS. 3*d* and 3*e*. Core 92 has a surface 93 and defines an opening 94. Illustrated core 92 has a circular or oval cross-section perpendicular to its perimeter, as best illustrated in FIG. 3*e*.

The outer surface 93 of inner core 92 and the inner surface 73 of outer core 72 bound winding space 90. One or more windings, Such as windings 30, 32, 34, 36 illustrated in FIG. 1, are wound on core 92. As previously mentioned, leads for such (a) winding(s) exit outer core 72 through opening(s) 98. Then the two core halves 78 and 80 are assembled over the wound core 92, with or without (a) spacer(s) as appropriate. Finally, one or more windings, such as primary 20 illustrated in FIG. 1, are wound on outer core 72.

Figure 4:
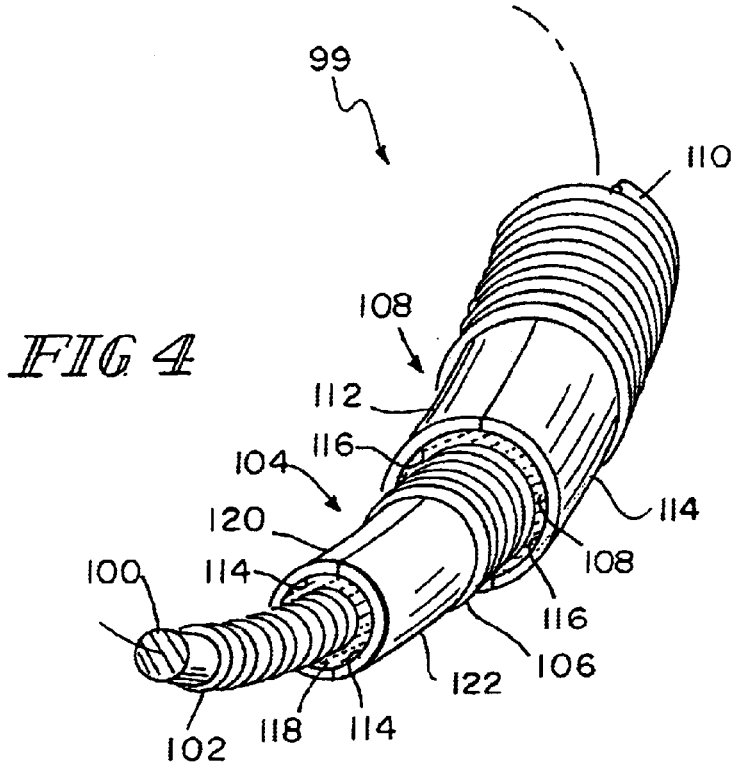
FIG. 4 illustrates a fragmentary perspective view of a transformer assembled from cores of the general types illustrated in FIGS. 3*a–c* and 3*d–e;*

A concentric core transformer may, of course, have any practical number of concentric cores and windings. FIG. 2 illustrates, although only schematically, a transformer having three such cores. FIG. 4 illustrates fragmentarily a transformer 99 having an inner core 100, (an) inner winding (s) 102 wound on inner core 100, a middle core 104, (a) middle winding(s) 106 wound on middle core 104, an outer core 108, and (an) outer winding(s) 110 wound on outer core 108. Outer core 108 and middle core 104 are similar to outer core 72 illustrated in FIGS. 3*a*, 3*b*, 3*c*, and 3*f*. Outer core 108 includes first and second mating hemitoroidal portions 112, 114 similar to portions 78, 80 described above. Portions 112, 114 include inner surfaces that cooperate to define a first winding space 118. Middle core 104 and winding(s) 106 are oriented within passage 118. Middle core 104 includes first and second mating hemitoroidal portions 120, 122 similar to portions 78, 80 described above. Portions 120, 122 include inner surfaces 123 that cooperate to define a second winding space 124. Core 100 and winding(s) 102 are oriented within passage 124. Core 100 is a one-piece core similar to core 92 illustrated in FIGS. 3*d–3f*. Cores 104, 108 include exit openings (not shown) through which leads of winding(s) 102 and 106 pass.

As illustrated in FIGS. 3*d*, 3*e*, 3*f* and 4, a concentric core transformer constructed from, or partly from, ferrite materials permits the construction of continuous cores. Due at least in part to the higher bulk resistively of ferrite materials and the reduction of outer core flux when using circuitry according to the invention, the need for (an) electrically non-conductive spacer(s) or the provision of (a) gap(s) to ensure the core material(s) do(es) not create (a) shorted turn(s) may be eliminated. In particular, cores 72, 108 illustrated in FIGS. 3*a*, 3*b*, 3*c*, 3*f*, and 4, may be assembled with no insulative spacer(s) or gap(s) between the portions 78, 80, 112, 114 of the respective cores 72, 108. Additionally, the abutting edges of the core portions 78, 80, 112, 114, for example, edges 84, 88 of portions 78, 80, between which such a gap would be defined may be polished to minimize such an air gap.

Figure 5:
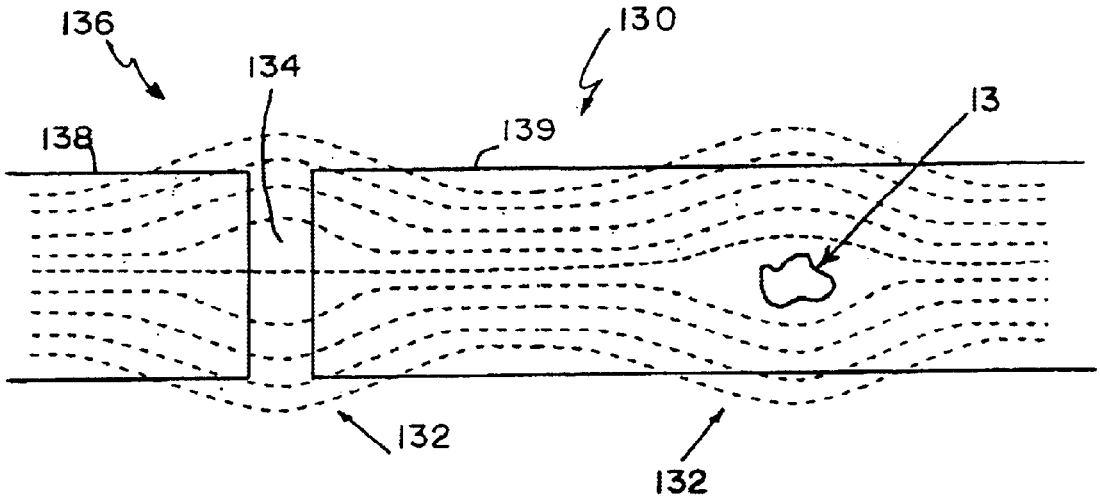
FIG. 5 (Prior Art)
FIG. 5 illustrates certain phenomena which typically can result in non-ideal performance in a prior art transformer.

Reducing the flux in a core of a transformer reduces the fringing effects associated with gaps and other areas of reduced permeability in the core material. For example, a prior art transformer 130 having a core 136 illustratively includes a gap 134 between portions 138 and 139. Transformer 130 exhibits the effects of fringing at gap 134, as illustrated in FIG. 5. Fringing generally occurs wherever magnetic flux lines 132 escape the region of high magnetic permeability (the bulk ferromagnetic material of the core 136), for example, where the flux lines 132 traverse gap 134, or where the flux lines 132 pass through and around a magnetic void 137. However, because the circuitry of the present invention reduces the flux in the cores of the transformer of the present invention, fringing effects associated with gaps and other regions of reduced permeability in the core material are reduced. Reduction of fringing effects at gaps and other anomalies also facilitates the building up of cores from, for example, hemitoroidal components and other component designs in which cores are assembled from components.

Figure 6:
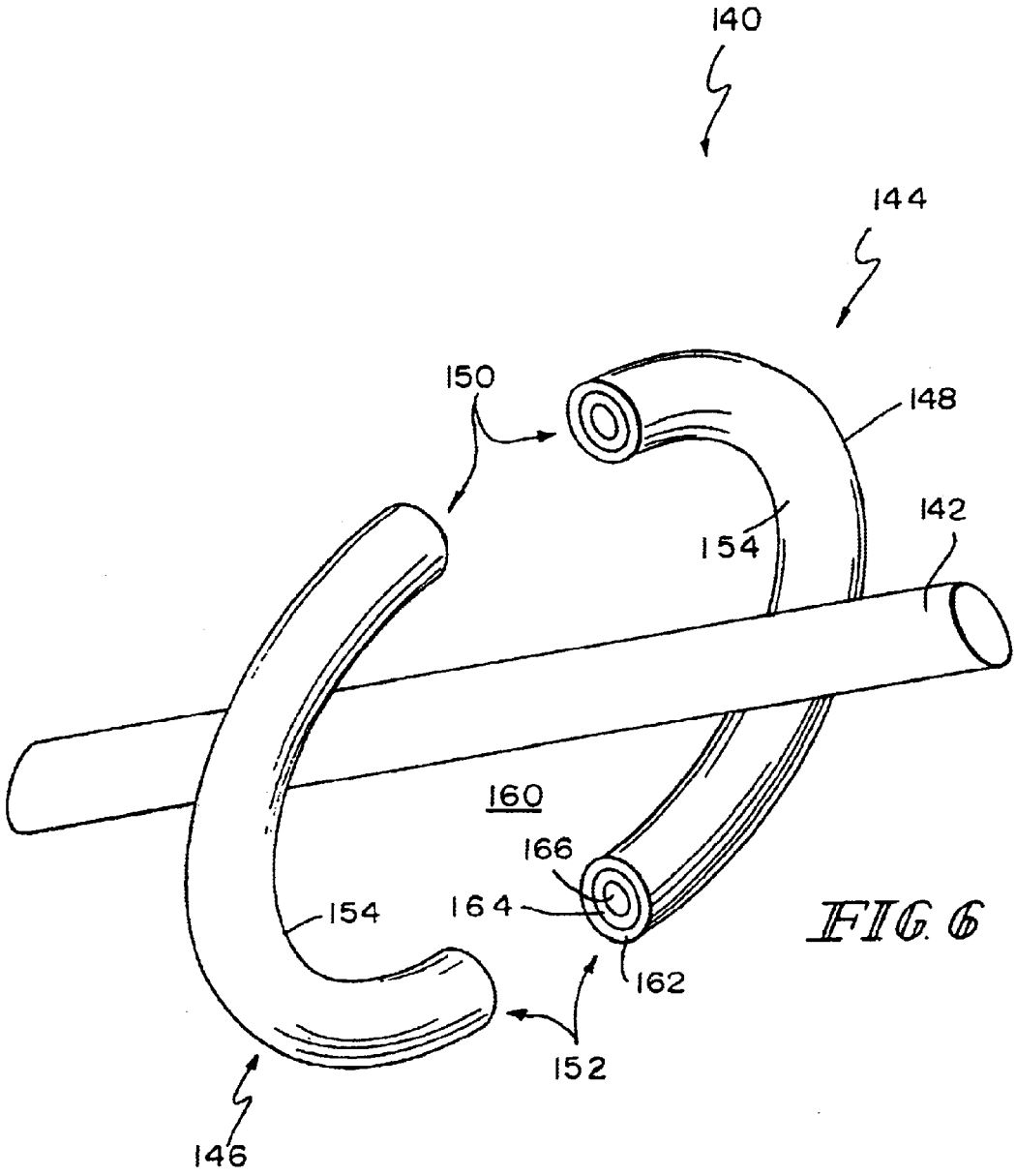
FIG. 6 illustrates a partly exploded perspective view of a transformer constructed according to the present invention disposed around a current carrying element.

As a further example of this benefit, FIG. 6 illustrates a compensated, concentric core transformer 140 constructed from two portions 144, 146. After placement around, for example, an electrical conductor 142, portions 144, 146 are joined to form the transformer 140 through the center opening 160 of which conductor 142 passes. Conductor 142 may, for example, comprise the primary winding of transformer 140. Transformer 140 includes an outer core 162, (a) winding(s) (not shown) wound on outer core 162, a winding space 164 within outer core 162, an inner core 166 disposed in winding space 164, and (a) winding(s) (not shown) wound on inner core 166 Portions 144, 146 are each generally C-shaped and terminate at first and second ends 150, 152. Portions 144, 146 each have an inner perimeter 154 that faces toward element 142 and an Outer perimeter 148 that faces away from element 142. When portions 144, 146 are coupled together, ends 150 of portions 144, 146 confront or abut each other, and ends 152 of portions 144, 146 confront or abut each other. Ends 150, 152 may be polished or otherwise treated to reduce any discontinuities in the cores 162, 166.

Dividing a transformer as illustrated in FIG. 6 permits the transformer to be clamped around an element without disturbing the integrity of the element. The ability to clamp around an element without disturbing the integrity of the element permits, for example, a compensated, concentric core transformer to be adapted to form a high performance clamp-on current transformer.

Although ferrites and supermalloy are discussed as core materials, it is within the scope of this disclosure for other materials to be used. Although the illustrated cores all have circular or generally circular cross sections transverse to their axes, it is within the scope of this disclosure for the cores to have ally desired regular or irregular closed plane curve cross sections transverse to their axes, including, without limitation, elliptical, triangular, quadrangular, pentagonal, and so on.

Other embodiments of the apparatus and methods of the present invention may not include all the features described. Those of ordinary skill in the art may readily devise their own implementations of the apparatus and methods of the present disclosure that still fall within the spirit and scope of the invention defined by the appended claims.

What is claimed is:

1. In combination, a transformer including at least one core of ferromagnetic material, a first winding across which an exciting voltage is to be applied, the first winding provided on one of the cores, a second winding provided on one of the cores, the second winding including first and second terminals across which a voltage is to be induced in response to the exciting voltage, a first device for providing a relatively higher impedance between the first and second terminals of the second winding, the first device coupled between the first and second terminals, one of the terminals of the second winding adapted for coupling to a relatively lower impedance, third, fourth and fifth windings, the third winding having first and second terminals, the fourth winding having first and second terminals, the fifth winding having first and second terminals, the third and fourth windings being wound on one of the cores with a first polarity, and the fifth winding being wound on one of the cores with a second polarity opposite to the first polarity, a second device for providing a relatively higher impedance between at least one pair of the following pairs of terminals: the first and second terminals of the third winding; the first and second terminals of the fourth winding; and, the first and second terminals of the fifth winding, one of the first and second terminals of each of the third, fourth and fifth windings also adapted for coupling to the relatively lower impedance.

2. The combination of claim 1 wherein the first device comprises a first amplifier having an output terminal characterized by a relatively lower impedance and an input terminal characterized by a relatively higher impedance.

3. The combination of claim 2 wherein the said one of the terminals of the second winding is further coupled to the input terminal of the first amplifier.

4. The combination of claim 3 wherein the first amplifier comprises a substantially unity-gain amplifier.

5. The combination of claim 2 wherein the second device comprises a second amplifier having an output terminal characterized by a relatively lower impedance and an input terminal characterized by a relatively higher impedance.

6. The combination of claim 5 wherein the said one of the terminals of the third winding is further coupled to the input terminal of the second amplifier.

7. The combination of claim 6 wherein at DC, the second amplifier comprises a substantially unity-gain amplifier.

8. The combination of claim 7 wherein the second amplifier comprises a differential amplifier having inverting and non-inverting input terminals, and further including a third device characterized by a relatively low impedance at DC for coupling the output terminal of the second amplifier to the inverting input terminal of the second amplifier at DC to constitute the second amplifier a unity gain amplifier at DC.

9. The combination of claim 8 wherein the third device comprises a bifilar inductor having a sixth winding and a seventh winding, the sixth and seventh windings being wound with the same polarity, the sixth and seventh windings including a common terminal coupled to the output terminal of the second amplifier, the remaining terminal of the sixth winding being coupled to the first terminal of the third winding and the remaining terminal of the seventh winding being coupled to the input terminal of the second amplifier.

10. The combination of claim 1 wherein the second device comprises an amplifier having an output terminal characterized by a relatively lower impedance and an input terminal characterized by the relatively higher impedance.

11. The combination of claim 10 wherein the said one of the terminals of the third winding is further coupled to the input terminal of the second device amplifier.

12. The combination of claim 11 wherein the second device amplifier comprises a substantially unity-gain amplifier at DC.

13. The combination of claim 12 wherein the second device amplifier comprises a differential amplifier having inverting and non-inverting input terminals, and further including a third device for coupling the output terminal of the second device amplifier to the inverting input terminal of the second device amplifier at DC to constitute the second device amplifier a unity gain amplifier at DC.

14. The combination of claim 13 wherein the third device comprises a bifilar inductor having a sixth winding and a seventh winding, the sixth and seventh windings being wound with the same polarity, the sixth and seventh windings including a common terminal coupled to the output terminal of the second device amplifier, the remaining terminal of the sixth winding being coupled to the first terminal of the third winding and the remaining terminal of the seventh winding being coupled to the input terminal of the second device amplifier.

15. The combination of claim 1 further comprising at least two cores with parallel axes, at least one of the first, second, third, fourth and fifth windings being wound on one of the cores and at least one of the first, second, third, fourth and fifth windings being wound on the other of the cores.

16. The combination of claim 15 wherein at least one of the cores is constructed from moldable ferromagnetic material.

17. The combination of claim 15 wherein the at least two cores have common axes.

18. The combination of claim 17 wherein at least one of the cores is constructed from moldable ferromagnetic material.

19. The combination of claim 18 wherein said at least one core is molded in multiple parts, the multiple parts being joined together during assembly of the transformer.

20. The combination of claim 15 further comprising more than two cores with parallel axes, at least one of the first, second, third, fourth and fifth windings being wound on a first one of the cores, at least one of the first, second, third, fourth and fifth windings being wound on a second of the cores, and at least one of the first, second, third, fourth and fifth windings being wound on a third of the cores.

21. The combination of claim 20 wherein the more than two cores have common axes.

22. The combination of claim 21 wherein at least one of the cores is constructed from moldable ferromagnetic material.

23. The combination of claim 22 wherein said at least one core is molded in multiple parts, the multiple parts being joined together during assembly of the transformer.

24. The combination of claim 20 wherein at least one of the cores is constructed from moldable ferromagnetic material.

25. A transformer comprising at least two magnetically coupled cores with a common axis, at least one winding being wound on one of the cores, the cores having cross sectional configurations transverse to the common axis which are not rectangular, a first one of the windings provided on a first one of the cores, a second one of the windings provided on a second one of the cores, the second winding including first and second terminals across which a voltage is to be induced in response to an exciting voltage applied across said first one of the windings, and a first device for providing a first impedance between the first and second terminals of the second winding, the first device coupled between the first and second terminals.

26. The apparatus of claim 25 wherein the first device for providing a first impedance between the first and second terminals of the second winding comprises a first device for providing a relatively higher impedance between the first and second terminals of the second winding, one of the terminals of the second winding adapted for coupling to a relatively lower impedance.

27. The apparatus of claim 26 wherein the first device comprises a first amplifier having an output terminal characterized by a relatively lower impedance and an input terminal characterized by a relatively higher impedance.

28. The apparatus of claim 27 wherein the said one of the terminals of the second winding is further coupled to the input terminal of the first amplifier.

29. The apparatus of claim 28 wherein the first amplifier comprises a substantially unity-gain amplifier.

30. The apparatus of claim 26 further comprising third, fourth and fifth windings, the third winding having first and second terminals, the fourth winding having first and second terminals, the fifth winding having first and second terminals, the third and fourth windings being wound on one of the cores with a first polarity, and the fifth winding being wound on one of the cores with a second polarity opposite to the first polarity, a second device for providing a relatively higher impedance between at least one pair of the following pairs of terminals: the first and second terminals of the third winding; the first and second terminals of the fourth winding; and, the first and second terminals of the fifth winding, one of the first and second terminals of each of the third, fourth and fifth windings also adapted for coupling to the relatively lower impedance.

31. The apparatus of claim 30 wherein the second device comprises a second amplifier having an output terminal characterized by a relatively lower impedance and an input terminal characterized by a relatively higher impedance.

32. The apparatus of claim 31 wherein the said one of the terminals of the third winding is further coupled to the input terminal of the second amplifier.

33. The apparatus of claim 32 wherein at DC, the second amplifier comprises a substantially unity-gain amplifier.

34. The apparatus of claim 33 wherein the second amplifier comprises a differential amplifier having inverting and non-inverting input terminals, and further including a third device characterized by a relatively low impedance at DC for coupling the output terminal of the second amplifier to the inverting input terminal of the second amplifier at DC to constitute the second amplifier a unity gain amplifier at DC.

35. The apparatus of claim 34 wherein the third device comprises a bifilar inductor having a sixth winding and a seventh winding, the sixth and seventh windings being wound with the same polarity, the sixth and seventh windings including a common terminal coupled to the output terminal of the second amplifier, the remaining terminal of the sixth winding being coupled to the first terminal of the third winding and the remaining terminal of the seventh winding being coupled to the input terminal of the second amplifier.

36. A transformer comprising at least two magnetically coupled cores with a common axis, at least one winding being wound on one of the cores, the cores having cross sectional configurations transverse to the common axis which are not rectangular, third, fourth and fifth windings, the third winding having first and second terminals, the fourth winding having first and second terminals, the fifth winding having first and second terminals, the third and fourth windings being wound on one of the cores with a first polarity, and the fifth winding being wound on one of the cores with a second polarity opposite to the first polarity, an amplifier having an output terminal characterized by a relatively much lower impedance and an input terminal characterized by a relatively higher impedance for providing a relatively higher impedance between at least one pair of the following pairs of terminals: the first and second terminals of the third winding; the first and second terminals of the fourth winding; and, the first and second terminals of the fifth winding, one of the first and second terminals of each of the third, fourth and fifth windings also adapted for coupling to the relatively lower impedance.

37. The apparatus of claim 36 wherein the said one of the terminals of the third winding is further coupled to the input terminal of the amplifier.

38. The apparatus of claim 37 wherein the amplifier comprises a substantially unity-gain amplifier at DC.

39. The apparatus of claim 38 wherein the amplifier comprises a differential amplifier having inverting and non-inverting input terminals, and further including a third device for coupling the output terminal of the amplifier to the inverting input terminal of the second device amplifier at DC to constitute the second device amplifier a unity gain amplifier at DC.

40. The apparatus of claim 39 wherein the third device comprises a bifilar inductor having a sixth winding and a seventh winding, the sixth and seventh windings being wound with the same polarity, the sixth and seventh windings including a common terminal coupled to the output terminal of the second device amplifier, the remaining terminal of the sixth winding being coupled to the first terminal of the third winding and the remaining terminal of the seventh winding being coupled to the input terminal of the second device amplifier.

41. In combination, a transformer including at least one core of ferromagnetic material, a first winding across which an exciting voltage is to be applied, the first winding provided on one of the cores, second, third and fourth windings, the second winding having first and second terminals, the third winding having first and second terminals, the fourth winding having first and second terminals, the second and third windings being wound on one of the cores with a first polarity, and the fourth winding being wound on one of the cores with a second polarity opposite to the first polarity, a first device for providing a relatively higher impedance between at least one pair of the following pairs of terminals: the first and second terminals of the second winding; the first and second terminals of the third winding; and, the first and second terminals of the fourth winding, one of the first and second terminals of each of the second, third and fourth windings also adapted for coupling to a relatively lower impedance, fifth, sixth and seventh windings, the fifth winding having first and second terminals, the sixth winding having first and second terminals, the seventh winding having first and second terminals, the fifth and sixth windings being wound on one of the cores with a first polarity, and the seventh winding being wound on one of the cores with a second polarity opposite to the first polarity, a second device for providing a relatively higher impedance between at least one pair of the following pairs of terminals: the first and second terminals of the fifth winding; the first and second terminals of the sixth winding; and, the first and second terminals of the seventh winding, one of the first and second terminals of each of the fifth, sixth and seventh windings also adapted for coupling to the relatively lower impedance.

42. The combination of claim 41 wherein the first and second devices comprise a first amplifier and a second amplifier, respectively, each of the first and second amplifiers having an output terminal characterized by a relatively lower impedance and an input terminal characterized by a relatively higher impedance.

43. The combination of claim 42 wherein the said one of the terminals of the second winding is further coupled to the input terminal of the first amplifier and the said one of the terminals of the fifth winding is further coupled to the input terminal of the second amplifier.

44. The combination of claim 43 wherein at DC, each of the first and second amplifiers comprises a substantially unity-gain amplifier.

45. The combination of claim 44 wherein each of the first and second amplifiers comprises a differential amplifier having inverting and non-inverting input terminals, and further including a third device and a fourth device, each of the third and fourth devices characterized by a relatively low impedance at DC, the third device for coupling the output terminal of the first amplifier to the inverting input terminal of the first amplifier at DC to constitute the first amplifier a unity gain amplifier at DC, and the fourth device for coupling the output terminal of the second amplifier to the inverting input terminal of the second amplifier at DC to constitute each of the first and second amplifiers a unity gain amplifier at DC.

46. The combination of claim 45 wherein each of the third and fourth devices comprises a bifilar inductor, the third device having an eighth winding and a ninth winding, the eighth and ninth windings being wound with the same polarity, the eighth and ninth windings including a common terminal coupled to the output terminal of the first amplifier, the remaining terminal of the eighth winding being coupled to the first terminal of the second winding and the remaining terminal of the ninth winding being coupled to the input terminal of the first amplifier, the fourth device having a tenth winding and an eleventh winding, the tenth and eleventh windings being wound with the same polarity, the tenth and eleventh windings including a common terminal coupled to the output terminal of the second amplifier, the remaining terminal of the tenth winding being coupled to the first terminal of the fifth winding and the remaining terminal of the eleventh winding being coupled to the input terminal of the second amplifier.

47. The combination of claim 41 further comprising an eighth winding provided on one of the cores, the eighth winding including first and second terminals across which a voltage is to be induced in response to the exciting voltage, a third device for providing a relatively higher impedance between the first and second terminals of the eighth winding, the third device coupled between the first and second terminals, one of the terminals of the eighth winding adapted for coupling to the relatively lower impedance.

48. The combination of claim 47 wherein the third device comprises a third device amplifier having an output terminal characterized by a relatively lower impedance and an input terminal characterized by a relatively higher impedance.

49. The combination of claim 48 wherein the said one of the terminals of the eighth winding is further coupled to the input terminal of the third device amplifier.

50. The combination of claim 49 wherein the third device amplifier comprises a substantially unity-gain amplifier.

51. The combination of claim 41 further comprising at least two cores with parallel axes, at least one of the first, second, third, fourth, fifth, sixth and seventh windings being wound on one of the cores and at least one of the first, second, third, fourth, fifth, sixth and seventh windings being wound on the other of the cores.

52. The combination of claim 51 wherein at least one of the cores is constructed from a moldable ferromagnetic material.

53. The combination of claim 51 wherein the at least two cores have common axes.

54. The combination of claim 53 wherein at least one of the cores is constructed from a moldable ferromagnetic material.

55. The combination of claim 54 wherein said at least one core is molded in multiple parts, the multiple parts being joined together during assembly of the transformer.

56. The combination of claim 51 further comprising more than two cores with parallel axes, at least one of the first, second, third, fourth, fifth, sixth and seventh windings being wound on a first one of the cores, at least one of the first, second, third, fourth, fifth, sixth and seventh windings being wound on a second of the cores, and at least one of the first, second, second, third, fourth, fifth, sixth and seventh windings being wound on a third of the cores.

57. The combination of claim 56 wherein at least one of the cores is constructed from a moldable ferromagnetic material.

58. The combination of claim 56 wherein the more than two cores have common axes.

59. The combination of claim 58 wherein at least one of the cores is constructed from a moldable ferromagnetic material.

60. The combination of claim 59 wherein said at least one core is molded in multiple parts, the multiple parts being joined together during assembly of the transformer.

* * * * *